United States Patent [19]

Johnston

[11] Patent Number: 4,478,263

[45] Date of Patent: Oct. 23, 1984

[54] LOG SPLITTER

[76] Inventor: James L. Johnston, P.O. Box 1209, El Granada, Calif. 94018

[21] Appl. No.: 477,946

[22] Filed: Mar. 23, 1983

[51] Int. Cl.[3] ..... B27L 7/00

[52] U.S. Cl. ..... 144/3 K; 144/193 A; 144/193 E

[58] Field of Search ..... 144/193 R, 193 A, 193 E, 144/194, 3 K, 366

[56] References Cited

U.S. PATENT DOCUMENTS

| | | | |
|---|---|---|---|
| 4,078,591 | 3/1978 | Syrjälä144 | 193 A/ |
| 4,269,242 | 5/1981 | Smith et al. | 144/3 K |
| 4,373,564 | 2/1983 | Heikkinen | 144/3 K |
| 4,388,957 | 6/1983 | Schilling | 144/193 R |

FOREIGN PATENT DOCUMENTS

| | | | |
|---|---|---|---|
| 1097193 | 3/1981 | Canada | 144/193 A |
| 85257 | 10/1920 | Switzerland | 144/193 R |

OTHER PUBLICATIONS

"The Bloomfield Harvester", 1/2/1978.

*Primary Examiner*—W. D. Bray
*Assistant Examiner*—Jorji M. Griffin
*Attorney, Agent, or Firm*—B. Deon Criddle

[57] ABSTRACT

A mobile self-contained wood processing machine to be used for the processing of logs into specific lengths and then splitting the lengths into individual pieces suitable for use as firewood or the like. The individual pieces are retained in a unit bin until a desired quantity has been processed. Once the desired quantity is processed the unit bin is operated to release the stored pieces to a handling cart or to packaging.

6 Claims, 4 Drawing Figures

LOG SPLITTER

BACKGROUND OF THE INVENTION

Field of the Invention

This invention relates to wood processing machines for the multiple cutting of logs as well as the multiple splitting of the cut logs into individual pieces suitable for use as firewood or the like.

The need for more economical processing of firewood has long been recognized. With the demands for all forms of energy increasing, the need becomes greater today than ever before. Patents related to the cutting and splitting of firewood disclose log handling equipment that includes apparatus for cutting and splitting logs. U.S. Pat. No. 4,294,295 for example, discloses an apparatus for saw cutting and for splitting firewood using radiating blades on a portable transport. U.S. Pat. No. 4,076,061 discloses a portable trailer with a shearing structure and a wedge assembly for splitting a sheared log into four pieces. A conveyor is used to move logs to a cutter and a winch assembly moves logs onto the conveyor. U.S. Pat. Nos. 4,160,470 and 4,219,057 each disclose a transportable log shearing unit and a splitting device having radiating blades to produce firewood. This assembly is also mounted on a trailer transport and has an extending arm for picking up logs and for positioning the logs in the shearing conveyor. U.S. Pat. No. 4,019,548 discloses a machine for shear slicing of wood in pieces and a similar device is shown in U.S. Pat. No. 3,802,473. U.S. Pat. No. 3,116,772 discloses a method for slicing vegetables with multiple cutter blades. To the best of my knowledge, there has not heretofore been available a log cutter and splitter that will efficiently simultaneously cut multiple log lengths, split them into firewood pieces of varying cross-sectional dimensions, and maintain them in a bundled condition for ready packaging for market.

Summary of the Invention

Principal objects of the present invention are to provide an efficient means for processing a log into log segments and to then split the log segments into fireplace pieces while maintaining continuity of the pieces for packaging, thereby gaining economy and greater output of product through simplicity of operations.

Another object of the invention is to provide a splitter that directs the splitting forces away from the center of each log segment thereby decreasing the pressure required to split the log segments and reducing the possibility of logs jamming in the splitter head.

Still another object of the invention is to provide a means of stabilizing a log while it is cut, without the use of movable mechanical locking devices.

Other objects and features of the invention will become apparent from the following detailed description taken together with the accompanying drawings.

THE DRAWINGS

In the drawings:

FIG. 1, is a perspective view of the wood processor and its mobile transport;

FIG. 2, a cross section through the log splitting chamber taken on the line 2—2 of FIG. 1 and showing the splitting knives of the cutter head;

FIG. 3, a longitudinal section through the log splitting chamber taken on the line 3—3 of FIG. 2, to show the longitudinal arrangement of the splitting knives; and FIG. 4, an enlarged perspective view of a pair of the splitting knives and their attachment to one another.

DETAILED DESCRIPTION

Figure 1:
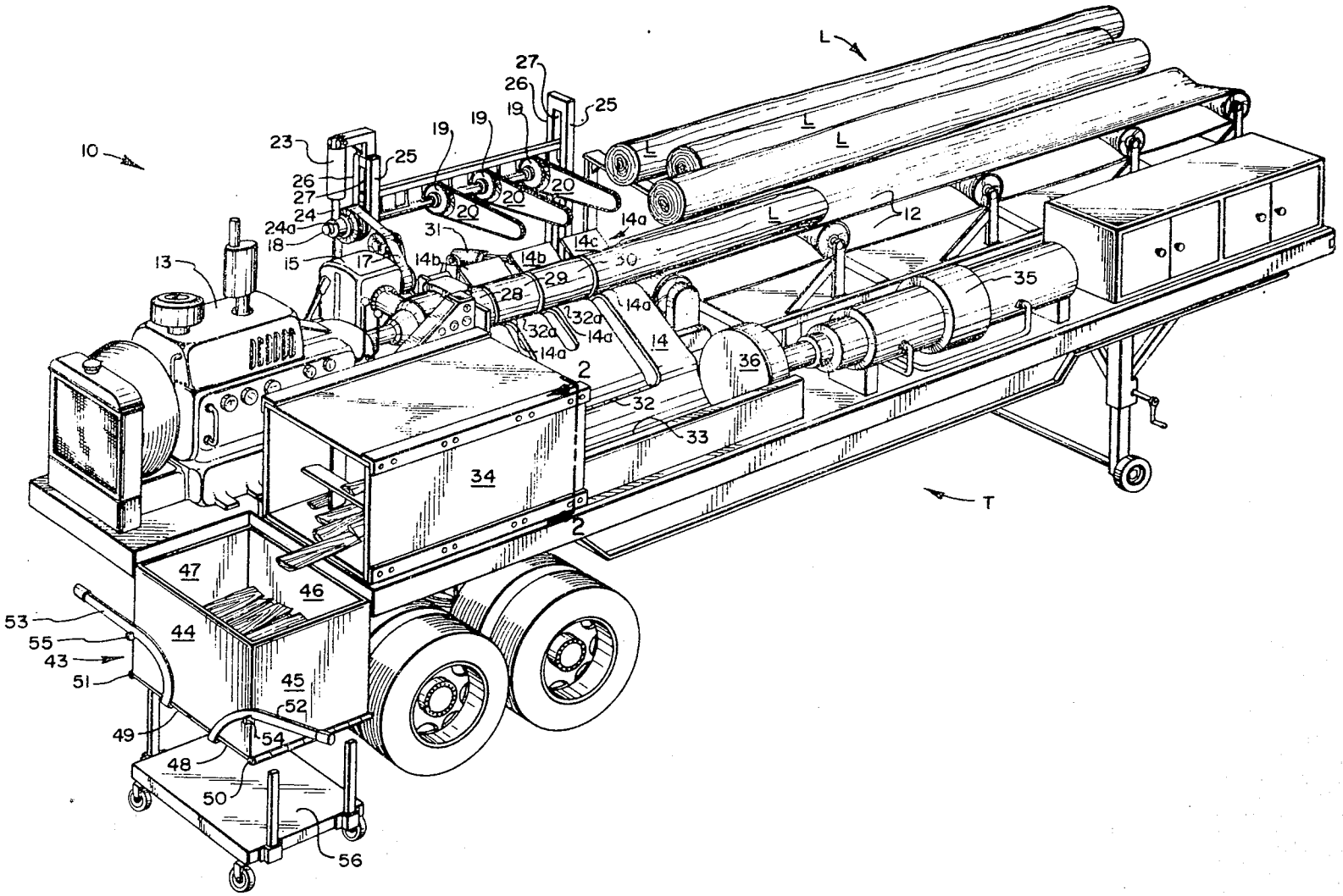

Referring now to the drawings:

In the illustrated preferred embodiment, the wood processor is shown generally at 10 mounted on a trailer shown generally at T. The processor includes a log holding section shown generally at 11 and a conveyor 12 which is operated by a power source 13. Logs L, individually rolled onto the conveyor 12 are moved by the belt and are discharged therefrom the slide into a trough 14*a* formed by a curve in each of the fingers 14*b* and 14*c* attached to a lift plate 14. As will become more apparent, fingers 14*b* are movable and finger 14*c* is fixed. A limit switch (not shown) is actuated when a log advances to the remote edge of the finger 14*b* furthest from conveyor 12. Upon contact by the log the limit switch shuts off conveyor 12 and activates power from the power source 13 to transmission 15, which in turn powers pulley 16, to turn drive belt 17 that passes over a pivoted and biased idler pulley and to operate drive shaft 18. Drive shaft 18 has a series of chain saw drive sprockets 19 spaced therealong to drive cutting chains of chain saws 20.

Chain saws 20 are elevated above a log L while it moves into the trough 14*a*. Each adjacent pair of fingers 14 is separated by a slot 22. Each saw 20 is then aligned with a slot 22. Hydraulic cylinder 23 is activated by the turning of belt 17 and will cycle through one complete arm extension and retraction each time it is activated by the belt 17.

An arm 24 of cylinder 23 has a bearing housing 24*a* which contains a ring bearing (not shown) that slips over an end of drive shaft 18. When the hydraulic cylinder arm 24 is extended or retracted drive shaft 18 is moved up and down within guide slots 27 formed between parallel vertical supports 25 and 26. As the chain saws 20 are moved down they cut through log 21 making log segments 28, 29, and 30. The cutting chains of the chain saws pass through slots 22, between fingers 14, until the drive shaft 18 and arm 24 reach their most extended position to trip a limit switch and to cause retraction of the arm. When the arm 24 is fully retracted another switch is tripped to activate another hydraulic cylinder 31 to move fingers 14*b*. Movable fingers 14*b* are connected to plate 14 by a hinge 32, and as the rod of hydraulic cylinder 31 is extended it lifts fingers 14*b* so that they pivot about the hinge 32. Eventually the incline of the fingers 14*b* becomes so great that log segments 28,29 and 30 roll over a retaining curb 32*b* forming an edge of the trough 14*a* and into a receiving chamber 33 which aligns the log segments in aligned position to be sequentially pushed through a log splitter chamber 34. As the fingers 14 are pivoted upward by the hydraulic cylinder 31 the chain saws 20 and drive shaft 18 are also retracted upwards by hydraulic cylinder 23 to reach their highest or resting position concurrently with the tilting of fingers 14 to their extreme raised position. When fingers 14 reach their extreme lowered position they activate the limit switch which powers conveyor 12, and the entire process is repeated.

A large hydraulic ram 35 operates each time conveyor belt 12 is activated to complete one full extension and contraction. Hydraulic ram 35 clears the receiving chamber 33 as it is extended by pushing the log segments 28 and 29 completely through the splitter chamber 34. However, it preferably retracts after the segment 30 has cleared the receiving chamber 33 and before the log segment 30 is completely through the splitting chamber 34 so that a face plate 36 at the end of the ram does not make contact with splitter knives of the splitting chamber. Log segment 30 is retained in the knives and will not be completely pushed through until the next cycle of log segments are pushed through by the hydraulic ram 35.

As split log segments are pushed fully through the log splitter chamber they drop into a hopper 43. The hopper 43 has an open top to receive log segments and solid side walls 44,45,46, and 47, respectively, that retain the log segments. It also has a hinged bottom that consists of two hinged doors 48 and 49 that pivot about hinges 50 and 51, respectively. The hinged doors 48 and 49 are locked into closed position by handles 52 and 53 respectively that are pivotally connected to the doors. Handles 52 and 53 have notches therein to hook over flanges 54 and 55 respectively. To open doors 48 and 49 the operator lifts the handles 52 and 53 up off of flanges 54 and 55 thereby removing the notches from their locked position on the extension bar. The handles are rotated upwardly, towards the top or opened part of hopper 43, to permit the doors to open and the contents to fall onto a receiving cart 56. If desired, strings or wires can be placed in the hopper before the split wood drops in and the collected split wood can be tied into a bundle before being released from the hopper.

Figure 2:
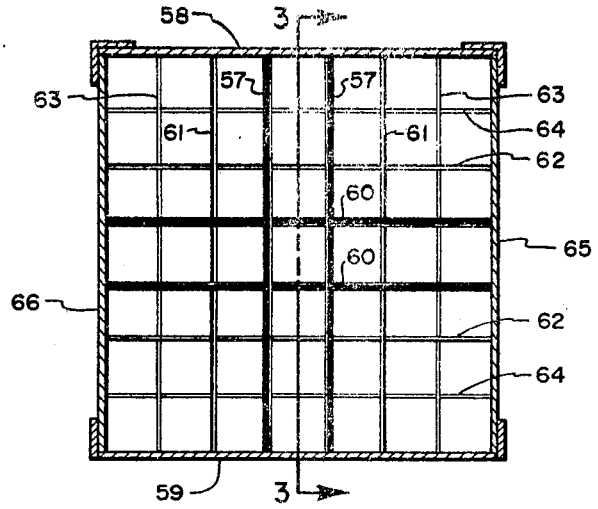
Figure 3:
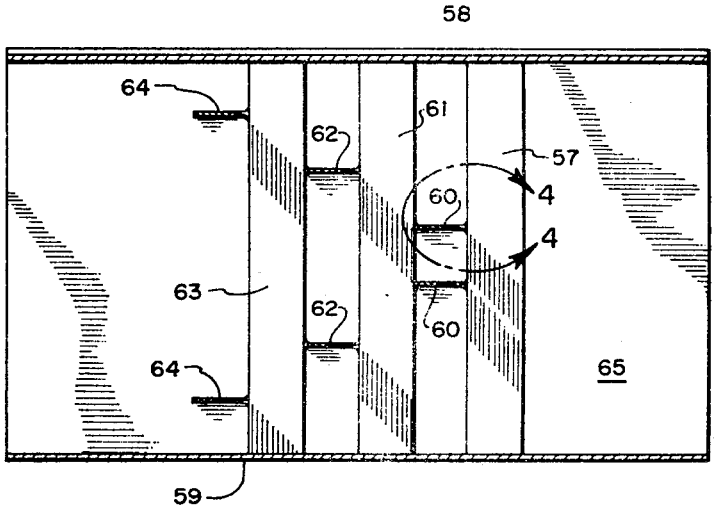
Figure 4:
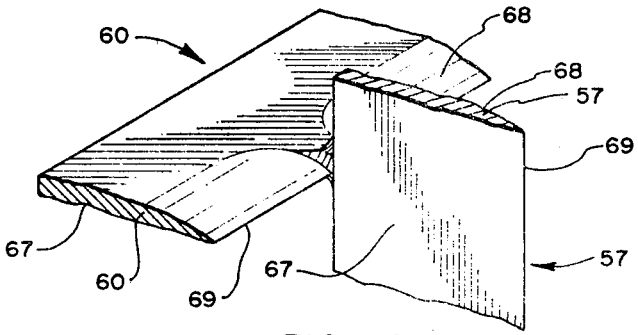

The arrangement of the splitter knives of the log splitter chamber 34 is best shown in FIGS. 2–4. As shown, pairs of splitter knives are arranged to provide sequential cutting or splitting by parallel sets of transversly arranged knives. Parallel knives 57 are the foremost knives and generally are the first to be engaged by the log segments forced into the splitter chamber by the hydraulic ram 35. The knives 57 extend between a top wall 58 and a bottom wall 59 of the splitter chamber. Parallel knives 60 extend transversely across and immediately behind the knives 57 and form a grid therewith; parallel knives 61 extend transversely across and immediately behind the knives 60; parallel knives 62 extend transversely across and immediately behind knives 61; parallel knives 63 extend transversely across and immediately behind knives 62; and parallel knives 64 extend transversely across and immediately behind knives 62. The knives are spaced such that when viewed from either the entrance to the splitter chamber 34 or from the exit therefrom a grid pattern having square spaces is formed. The vertical knives 57,61 and 63 are all fixed to the top wall 58 and bottom wall 59 of the splitter chamber and the horizontal knives are all fixed at their opposite ends to side walls 65 and 66 of the splitter chamber. Preferably each pair of knives behind another pair (as viewed from the entrance to the splitter chamber) is welded to the forward pair to give additional stability to the knives. Each of the knives 57 and 60–64 has a flat or straight surface 67, as best seen in FIG. 4, and an outer curved surface 68 that arcs back from the knife cutting edge 69. The flat and curved surfaces of the knife are important in the log splitting operation since the flat inner surface 67 holds the log parallel to the hydraulic ram while the curved surface 61 lifts and splits the log apart, always moving the split section of the log away from the central portion of the log. It has been found that this movement of split pieces, together with the sequential engagement of the pairs of knives with the log, as the log is forced through the splitter chamber, greatly reduces the pressure required to force log segments through the chamber.

While a preferred form of my invention has herein been disclosed, it is to be understood that the present disclosure is made by way of example, and that variations are possible without departing from the subject matter coming within the scope of the following claims, which subject matter I regard as my invention.

I claim:

1. A wood processing machine comprising an endless conveyor adapted to receive logs to be cut into log segments;

switch means to stop the endless conveyor when a log has been positioned to be cut into log segments;

a trough receiving a log to be cut from the conveyor, said trough including, spaced apart fingers forming a portion of a log supporting surface of the trough;

saw means arranged to simultaneously provide a plurality of cuts through a log in the trough and to move between said fingers, whereby a plurality of log segments are formed in the trough;

a receiving chamber;

means for pivoting said fingers to simultaneously discharge said plurality of cut log segments from the trough to the receiving chamber with said log segments in axially aligned relationship in the receiving chamber;

a log segment splitter aligned with the receiving chamber; and ram means aligned with the receiving chamber and the log segment splitter, whereby operation of the ram means will force the log segments sequentially through the log segment splitter.

2. A wood processing machine as in claim 1, wherein the log segment splitter comprises a splitter chamber having, top bottom and side walls and an open entrance end and an open discharge end;

a plurality of pairs, of parallel, spaced apart cutter knives fixed in the splitter chamber, with cutter knives of each succeeding pair of knives being further spaced apart from the knives of the preceding pair and extending transverse to, immediately behind and engaging the proceeding pair in a grid pattern when viewed from the entrance and discharge ends, whereby cutting edges of each succeeding pair of knives are sequentially engaged by an end of a log segment forced through the splitter chamber.

3. A wood processing machine as in claim 2, wherein an inner surface of each knife is flat and an outer surface is arcuately curved away from the cutting edge whereby split pieces of log segments are directed outwardly as the log segments are forced through the splitter chamber.

4. A wood processor as in claim 3, further including a hopper at the discharge end of the splitter chamber said hopper having discharge door means at the bottom thereof.

5. A splitter chamber for wood processing machines including top, bottom and side walls an open entrance end and an open discharge end;

a plurality of pairs of parallel spaced apart cutter knives fixed within the top, bottom and side walls, and with cutting edges of the knives of each succeeding pair of knives being further spaced apart from the knives of the preceding pair and extending transverse to, immediately behind the preceeding pair to form a grid pattern when viewed from the entrance and discharge ends, whereby cutting edges of each succeeding pair of knives are sequentially engaged by an end of a log segment forced through the splitter chamber from the entrance end to the discharge end.

6. A splitter chamber for wood processing machines as in claim 5, wherein an inner surface of each knife is flat and an outer surface is arcuately curved away from the cutting edge whereby split pieces of log segments are directed outwardly as the log segments are forced through the splitter chamber.

* * * * *